US012359515B2

(12) United States Patent
Natarajan

(10) Patent No.: US 12,359,515 B2
(45) Date of Patent: Jul. 15, 2025

(54) DRILL CAROUSEL FOR MACHINE

(71) Applicant: Caterpillar Global Mining Equipment LLC, Denison, TX (US)

(72) Inventor: Yagneshwar Natarajan, Chennai (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 18/143,162

(22) Filed: May 4, 2023

(65) Prior Publication Data

US 2023/0366276 A1 Nov. 16, 2023

(30) Foreign Application Priority Data

May 11, 2022 (AU) ..... 2022203165

(51) Int. Cl.
*E21B 19/14* (2006.01)

(52) U.S. Cl.
CPC ..... *E21B 19/146* (2013.01)

(58) Field of Classification Search
CPC ..... E21B 19/146; E21B 19/20; E21B 19/15; E21B 19/00; B65D 85/20
See application file for complete search history.

(56) References Cited

U.S. PATENT DOCUMENTS 3,185,310 A * 5/1965 Klem ..... E21B 19/20 175/85
4,202,653 A 5/1980 Moller
4,445,579 A 5/1984 Bello
4,455,116 A * 6/1984 Lindstedt ..... E21B 19/146 175/52
4,733,789 A * 3/1988 Olson ..... E21B 12/00 220/8
6,244,360 B1 * 6/2001 Steinsland ..... E21B 19/146 175/85
7,631,704 B2 * 12/2009 Hagemeyer ..... E21B 19/18 166/380
7,886,846 B2 * 2/2011 Pires ..... E21B 19/146 175/85
8,360,237 B2 * 1/2013 Weaver ..... E21B 10/00 206/349
10,151,155 B2 * 12/2018 Jones ..... E21B 19/146
10,871,042 B2 12/2020 Gonzalez
2018/0291696 A1 * 10/2018 Amerson ..... E21B 19/18
(Continued)

FOREIGN PATENT DOCUMENTS

CN 112744462 A * 5/2021 ..... E21B 12/00
WO 2009156574 A1 12/2009

*Primary Examiner* — Gregory W Adams

(57) ABSTRACT

A pipe rack for a machine includes a drill carousel for supporting at least two drill strings. The drill carousel defines a first end and a second end spaced apart from the first end. The drill carousel includes a base disposed proximate to the first end of the drill carousel and a plurality of receptacles coupled to and extending from the base. At least two of the plurality of receptacles are adapted to at least partially receive a corresponding drill string from the at least two drill strings. The pipe rack also includes a retainer plate. The retainer plate is adapted to couple with the at least two drill strings. The pipe rack further includes at least one breaker plate disposed between the base and the retainer plate. The at least one breaker plate is spaced apart from the retainer plate along a first axis of the machine.

20 Claims, 7 Drawing Sheets

(56) References Cited

U.S. PATENT DOCUMENTS

| | | | |
|---|---|---|---|
| 2020/0308917 | A1 | 10/2020 | Diekmann et al. |
| 2021/0198957 | A1 | 7/2021 | Hellman |
| 2021/0237174 | A1 | 8/2021 | Cammack |

* cited by examiner

DRILL CAROUSEL FOR MACHINE

CROSS-REFERENCE TO RELATED APPLICATION

This application claims priority under 35 USC § 119 and the Paris Convention to Australian patent application No. 2022203165 filed on May 11, 2022.

TECHNICAL FIELD

The present disclosure relates to a pipe rack for a machine, and a drill carousel associated with the pipe rack.

BACKGROUND

A machine, such as a drilling machine, includes a drill string having a drill bit for performing one or more drilling operations at a worksite. The drill string containing a particular diameter of drill pipe and a slightly higher in diameter drill bit at its bottom end, is connected to a rotary head of the machine for drilling of holes matching the drill bit diameter. Further, a pipe rack may be associated with the machine. The pipe rack may include a drill carousel and a few drill pipes that may be coupled to the drill string for drilling holes of longer depths with respect to a ground surface.

In some cases, it may be desirable to drill holes of different diameters at the worksite. Conventional machines may not have a provision to drill holes having different diameters, due to which multiple machines may have to be employed at the worksite. In other examples, the drill string may have to be replaced for drilling of holes of different diameters. Further, in some examples, due to factors, such as soil conditions at the worksite, one type of drill string may have to be replaced by another type of drill string. For example, a drill string having a rotary drill bit may have to be replaced by a drill string having a down-the-hole hammer bit. Replacement of the drill strings may be a time-consuming process and may increase a downtime associated with the machine. Moreover, usage of multiple machines may increase an operating cost for a particular drilling operation, which is not desirable.

U.S. Pat. No. 10,871,042 describes a drill pipe rack for a mobile drilling machine. The drill pipe rack may comprise a plurality of tubular receptacles extending from a base of the drill pipe rack to form a cup configuration. The drill pipe rack may further comprise a set of bushings, each bushing of the set of bushings may be received in a respective receptacle. Additionally, each bushing may have the same inner diameter, the inner diameter corresponding to an outer diameter of a drilling pipe segment of the mobile drilling machine.

SUMMARY OF THE DISCLOSURE

In an aspect of the present disclosure, a pipe rack for a machine is provided. The pipe rack includes a drill carousel adapted to support at least two drill strings. The drill carousel defines a first end and a second end spaced apart from the first end along a first axis of the machine. The drill carousel includes a base disposed proximate to the first end of the drill carousel. The drill carousel also includes a plurality of receptacles coupled to and extending from the base. At least two of the plurality of receptacles are adapted to at least partially receive a corresponding drill string from the at least two drill strings. The pipe rack also includes a retainer plate coupled to the drill carousel proximate to the second end of the drill carousel. The retainer plate is adapted to couple with the at least two drill strings. The pipe rack further includes at least one breaker plate disposed between the base and the retainer plate. The at least one breaker plate is spaced apart from the retainer plate along the first axis.

In another aspect of the present disclosure, a machine is provided. The machine includes a frame. The machine also includes a drilling mast supported by the frame. The machine further includes a pipe rack mounted on the drilling mast. The pipe rack includes a drill carousel adapted to support at least two drill strings. The drill carousel defines a first end and a second end spaced apart from the first end along a first axis of the machine. The drill carousel includes a base disposed proximate to the first end of the drill carousel. The drill carousel also includes a plurality of receptacles coupled to and extending from the base. At least two of the plurality of receptacles are adapted to at least partially receive a corresponding drill string from the at least two drill strings. The pipe rack also includes a retainer plate coupled to the drill carousel proximate to the second end of the drill carousel. The retainer plate is adapted to couple with the at least two drill strings. The pipe rack further includes at least one breaker plate disposed between the base and the retainer plate. The at least one breaker plate is spaced apart from the retainer plate along the first axis.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
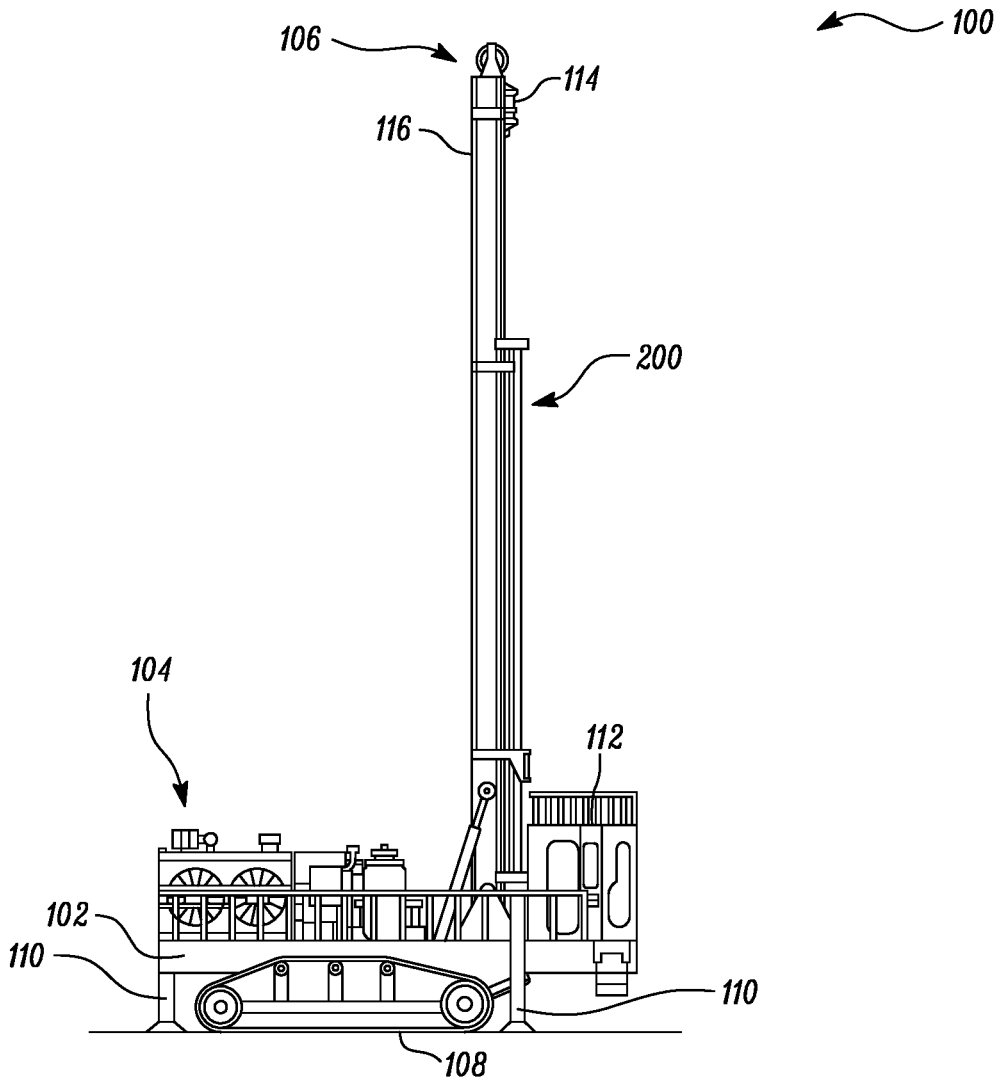
FIG. 1 is a side view of a machine, according to an embodiment of the present disclosure.

FIG. 1 illustrates a side view of an exemplary machine 100. In the illustrated embodiment of FIG. 1, the machine 100 is a blasthole drilling machine. However, the machine 100 may embody any other type of drilling machine, without any limitations. The machine 100 defines a first axis "A1". The first axis "A1" extends generally in a vertical direction.

As shown in FIG. 1, the machine 100 includes a frame 102. The machine 100 also includes machinery 104. Further, the machine 100 includes a drilling mast 106 supported by the frame 102. The frame 102 may be supported on a ground surface by a transport mechanism, such as, crawler tracks 108. The crawler tracks 108 may allow the machine 100 to maneuver on the ground surface to a desired location for a drilling operation. The frame 102 further includes one or more jacks 110 for supporting and leveling the machine 100 on the ground surface during the drilling operation. The frame 102 may support the machinery 104, which may include various components (not shown herein), such as, a power source (such as, one or more engines), motors, batteries, pumps, air compressors, and/or any other equipment necessary to power and operate the machine 100. The frame 102 further supports an operator cab 112, from which an operator may maneuver and control the machine 100.

As shown in FIG. 1, the drilling mast 106 includes a rotary drill head 114. The rotary drill head 114 may be supported on a mast frame 116 of the drilling mast 106. Further, the machine 100 may include one or more motors associated with the rotary drill head 114. The present disclosure relates to a pipe rack 200 for the machine 100. The machine 100 includes the pipe rack 200 mounted on the drilling mast 106, as shown schematically in FIG. 1. The pipe rack 200 may be mounted on the drilling mast 106 on two bearings (not shown) proximate to a top end and a bottom end of the pipe rack 200. The pipe rack 200 includes one or more drill strings 202, 204 (shown in FIG. 2). The pipe rack 200 may swing in and swing out of a drill center for feeding drill strings 202, 204 or drill pipes 206, 208 to the rotary drill head 114 and retrieving them back. The rotary drill head 114 may couple to, and rotate, the one or more drill strings 202, 204 for performing the drilling operation.

Figure 2:
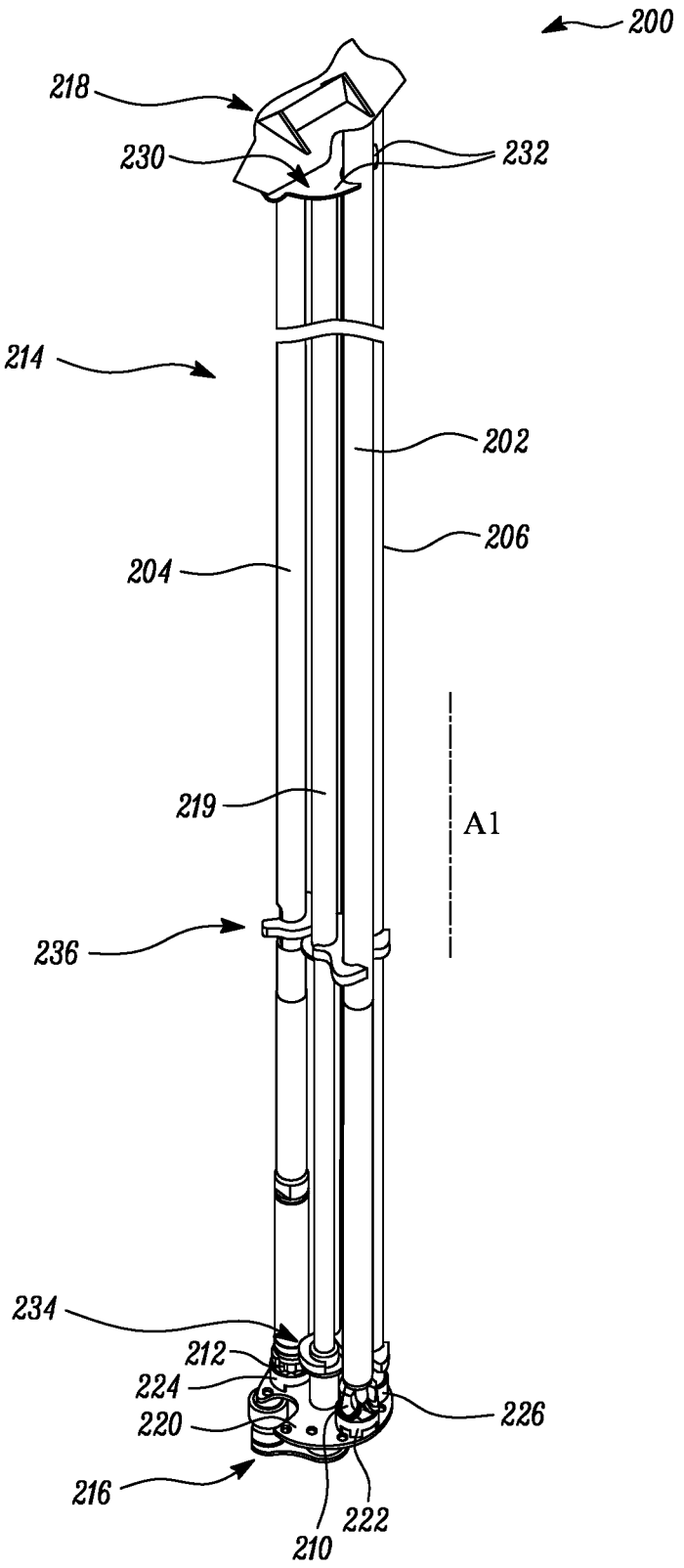
FIG. 2 is a perspective view of a pipe rack associated with the machine of FIG. 1, according to an embodiment of the present disclosure.

FIG. 2 illustrates a perspective view of the pipe rack 200. In the illustrated embodiment of FIG. 2, the pipe rack 200 includes two drill strings 202, 204 and two drill pipes 206, 208 (shown in FIG. 3). However, in some other embodiments, a number of the drill strings 202, 204 and a number of the drill pipes 206, 208 may vary, based on application requirements. For example, the pipe rack 200 may include three or more drill strings (similar to one of the drill strings 202, 204) and a single drill pipe (similar to any one of the drill pipes 206, 208), without any limitations. Each drill pipe 206, 208 may be coupled to a corresponding drill string 202, 204, based on a desired hole depth. More particularly, the drill pipe 206 may be coupled to the drill string 202, and the drill pipe 208 may be coupled to the drill string 204. Further, each of the two drill strings 202, 204 includes a drill bit 210, 212. Each drill string 202, 204 further includes an upper sub adaptor (not shown) and a lower sub adaptor (not shown).

In the illustrated embodiment of FIG. 2, the drill bit 210, 212 of each of the two or more drill strings 202, 204 are of different types. The drill bits 210, 212 may include a rotary drill bit or a down-the-hole (DTH) drill bit. In the illustrated embodiment of FIG. 2, the drill bit 210 includes the rotary drill bit and the drill bit 212 includes the DTH drill bit. Alternatively, the drill bit 210 may include the DTH drill bit and the drill bit 212 may include the rotary drill bit. However, in other embodiments, the drill bit 210, 212 of each of the two or more drill strings 202, 204 may be of a same type. For example, each drill bit 210, 212 may include the rotary drill bit or each drill bit 210, 212 may include the DTH drill bit.

Further, the drill bit 210, 212 of each of the two or more drill strings 202, 204 may be of a same size. In some examples, the drill bit 210 of the drill string 202 may have a first diameter "D1" and the drill bit 212 of the drill string 204 may have a second diameter "D2", such that the first diameter "D1" may be substantially equal to the second diameter "D2". Alternatively, the drill bit 210, 212 of each of the two or more drill strings 202, 204 may be of different sizes. For example, the first diameter "D1" may be different from the second diameter "D2". In some embodiments, the first and second diameters "D1", "D2" of the respective drill bits 210, 212 may be substantially equal to diameters of the drill pipes 206, 208, respectively. Further, the drill pipes 206, 208 may be of the same size or the drill pipes 206, 208 may be of different sizes, as per application requirements. In other words, the pipe rack 200 may be configurable to support drill pipes 206, 208 of different diameters or same diameters.

As illustrated in FIG. 2, the pipe rack 200 includes a drill carousel 214 that supports the two or more drill strings 202, 204. The drill carousel 214 defines a first end 216 and a second end 218 spaced apart from the first end 216 along the first axis "A1" of the machine 100 (see FIG. 1). The drill carousel 214 may spin about its central axis and is mounted to the pipe rack 200 on bearings proximal to the first and second ends 216, 218. Further, the drill carousel 214 includes a central support 219 extending between the first and second ends 216, 218. The drill carousel 214 may be indexed or positioned relative to the rotary drill head 114. Further, the drill carousel 214 may dispense and assist in engagement of the drill strings 202, 204 and/or the drill pipes 206, 208 with the rotary drill head 114. During operation of the machine 100, the pipe rack 200 may swing by an angle to couple the drill strings 202, 204 or the drill pipes 206, 208 with the rotary drill head 114. Further, the pipe rack 200 may move or swing away from the rotary drill head 114 after loading or unloading the drill strings 202, 204 or the drill pipes 206, 208 to or from the drill carousel 214 when the machine 100 normally performs the drilling operation.

The drill carousel 214 includes a base 220 disposed proximate to the first end 216 of the drill carousel 214. The base 220 is embodied as a plate member that is substantially circular in shape. The drill carousel 214 further includes a number of receptacles 222, 224, 226, 228 (shown in FIG. 4) coupled to and extending from the base 220.

Each receptacle 222, 224, 226, 228 is embodied as a generally cylindrical member extending from the base 220 along the first axis "A1". Further, two or more of the receptacles 222, 224 at least partially receive a corresponding drill string 202, 204 from the two or more drill strings 202, 204. In the illustrated embodiment of FIG. 2, the receptacle 222 receives a portion of the drill bit 210 and the receptacle 224 receives a portion of the drill bit 212. Alternatively, in examples wherein the pipe rack 200 includes four drill strings, each receptacle 222, 224, 226, 228 may at least partially receive a corresponding drill string (similar to the drill strings 202, 204). Further, the drill carousel 214 also supports the one or more drill pipes 206, 208. Specifically, the receptacles 226, 228 at least partially receive a portion of a corresponding drill pipe 206, 208.

In the illustrated embodiment of FIG. 2, the drill carousel 214 include four receptacles 222, 224, 226, 228. However, a total number of the receptacles may vary based on a size of the machine 100 (see FIG. 1). For example, the drill carousel 214 may include two receptacles or-more, each of which may receive a corresponding drill string (similar to the drill string 202, 204) and/or a drill pipe (similar to the drill pipe 206, 208), without any limitations.

The pipe rack 200 also includes a retainer plate 230 coupled to the drill carousel 214 proximate to the second end 218 of the drill carousel 214. The retainer plate 230 may assist in engagement of individual drill strings 202, 204 or drill pipes 206, 208 with the rotary drill head 114. The retainer plate 230 is coupled to the two or more drill strings 202, 204. The retainer plate 230 is also coupled to the drill pipes 206, 208. Accordingly, the retainer plate 230 may support each of the drill strings 202, 204 and the drill pipes 206, 208 proximate to the second end 218 of the drill carousel 214. The retainer plate 230 may embody any conventional retainer plate suitable to support the drill pipes 206, 208 and the drill strings 202, 204, without any limitations. In the illustrated embodiment of FIG. 2, the retainer plate 230 includes a number of first projections 232 (only two of which are illustrated herein). A portion of each of the drill strings 202, 204 and the drill pipes 206, 208 are received between two adjacent first projections 232 of the retainer plate 230 for supporting the drill strings 202, 204 and the drill pipes 206, 208 proximate to the second end 218 of the drill carousel 214.

Figure 3:
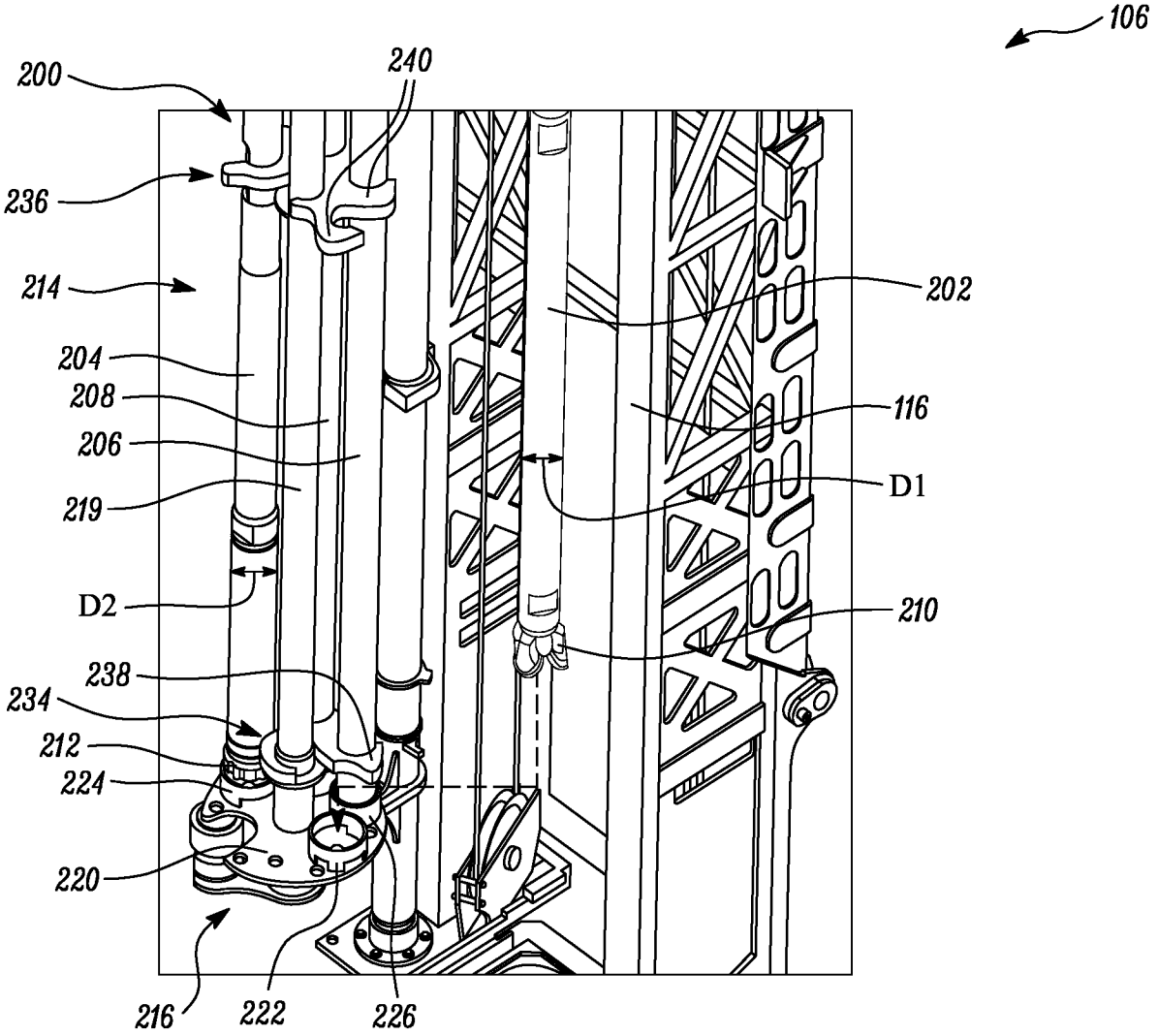
FIG. 3 is a perspective view of a portion of the pipe rack of FIG. 2.

FIG. 3 is a perspective view of a portion of the pipe rack 200 illustrating the drill string 202 coupled to the rotary drill head 114 and the drill string 204 coupled to the drill carousel 214. Referring to FIG. 3, the pipe rack 200 further includes one or more breaker plates 234, 236 disposed between the base 220 and the retainer plate 230. The one or more breaker plates 234, 236 are spaced apart from the retainer plate 230 along the first axis "A1". In the illustrated embodiment of FIG. 3, the breaker plates 234, 236 are disposed proximate to the first end 216 of the drill carousel 214. In various examples, a single breaker plate or more than one breaker plate (similar to the breaker plates 234, 236), may be used to support the drill strings 202, 204 and/or the drill pipes 206, 208 for their engagement with the rotary drill head 114.

In this illustration, the pipe rack 200 includes two breaker plates 234, 236 spaced apart from each other along the first axis "A1". Specifically, the one or more breaker plate 234, 236 includes a first breaker plate 234 disposed proximate to the base 220 and a second breaker plate 236 disposed between the first breaker plate 234 and the retainer plate 230. The first and second breaker plates 234, 246 are coupled with the drill pipes 206, 208 and/or the drill strings 202, 204. In the illustrated embodiment, the first breaker plate 234 is coupled to the one or more drill pipes 206, 208. Specifically, the first breaker plate 234 includes a number of second projections 238 (only one of which is illustrated herein). A portion of each drill pipe 206, 208 is received between two adjacent second projections 238 of the first breaker plate 234 for supporting the drill pipes 206, 208 proximate to the first end 216 of the drill carousel 214. Further, the two drill pipes 206, 208 may include across flats or any other provision (not shown herein) that engage with the second projections 238 of the first breaker plate 234 for supporting the two drill pipes 206, 208. The first breaker plate 234 may prevent a rotation of the drill pipes 206, 208 when one of the drill pipes 206, 208 is being added to, or removed from, the drill carousel 214, when the rotary drill head 114 engages or disengages with it. It should be noted that the first breaker plate 234 may embody any conventional breaker plate suitable to prevent the rotation of the drill pipes 206, 208, when engaged with the drill carousel 214.

Further, the second breaker plate 236 is coupled to each of the two or more drill strings 202, 204. Specifically, the second breaker plate 236 includes a number of third projections 240 (only two of which are illustrated herein). A portion of each drill string 202, 204 is received between two adjacent third projections 240 of the second breaker plate 236 for supporting the drill strings 202, 204 proximate to the first end 216 of the drill carousel 214. Further, the drill strings 202, 204 may include across flats or any other provision (not shown herein) that engage with the third projections 240 of the second breaker plate 236 for supporting the two drill strings 202, 204. The second breaker plate 236 may prevent a rotation of the drill strings 202, 204 when the drill string 202, 204 is being added to, or removed from, the drill carousel 214, when the rotary drill head 114 engages or disengages with it. It should be noted that the second breaker plate 236 may embody any conventional breaker plate suitable to prevent the rotation of the drill strings 202, 204, when engaged with the drill carousel 214.

Figure 4:
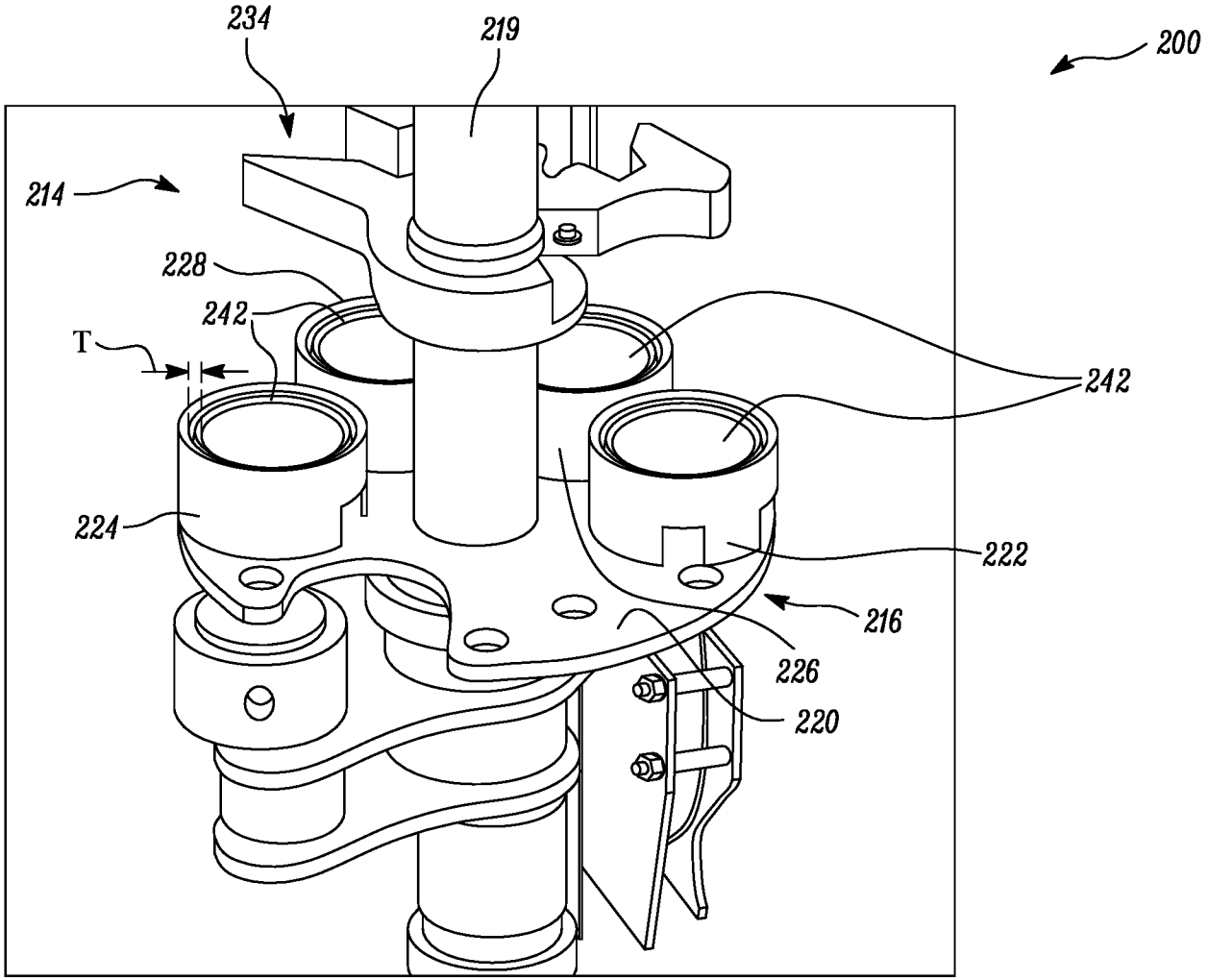
FIG. 4 is a perspective view of a drill carousel of the pipe rack of FIG. 3, according to an embodiment of the present disclosure.

Referring now to FIG. 4, a perspective view of the base 220 of the drill carousel 214 is illustrated. In some embodiments, the drill bits 210, 212 of the two drill strings 202, 204 may be of different sizes or different types. In order to accommodate the drill strings 202, 204 of different sizes or different types, one or more of the number of receptacles 222, 224 may removably receive a configurable sleeve 242 for accommodating the drill strings 202, 204 and/or the drill pipes 206, 208. More particularly, in some embodiments, the drill strings 202, 204 and/or the drill pipes 206, 208 may have different sizes or types. In such cases, one or more of the receptacles 226, 228 may also receive the configurable sleeve 242 for accommodating the drill strings 202, 204 and/or the drill pipes 206, 208 of different sizes or types, as per requirements. Further, the drill strings 202, 204 may be of different sizes and/or different types. Alternatively, the drill pipes 206, 208 may of the same size and/or same type. Moreover, the drill pipes 206, 208 may be of different sizes. Alternatively, the drill pipes 206, 208 may of the same size. It should be noted that the, in some examples, wherein the drill carousel 214 may not include any drill pipe 206, 208, the configurable sleeves 242 may only receive the drill strings 202, 204.

The configurable sleeve 242 may compensate a size difference between the drill bits 210, 212 or the drill pipes 206, 208 and a corresponding receptacle 222, 224, 226, 228, so that different sizes and/or different types of the drill bits 210, 212 and the drill pipes 206, 208 may be accommodated in the drill carousel 214. In the illustrated embodiment of FIG. 4, each receptacle 222, 224, 226, 228 receives a corresponding sleeve 242. Alternatively, only some of the receptacles 222, 224, 226, 228 may receive the configurable sleeve 242. Further, as the drill string 202 and the drill pipe 206 are of the same size, the configurable sleeves 242 in the receptacles 222, 226 may or may not be of the same size, as the diameter of the drill string 202, 204 at their bit end is usually slightly larger than the diameter of the drill pipe 206, 208.

As illustrated in FIG. 4, the configurable sleeve 242 is embodied as a cylindrical member. The configurable sleeve 242 may be concentrically disposed within the receptacle 222, 224, 226, 228. The configurable sleeve 242 may be removably coupled to the receptacle 222, 224, 226, 228 by a mechanical fastener (not shown), such as, bolts, screws, pins, dowels, and the like. The configurable sleeve 242 may include a thickness "T" that may vary based on the sizes of the drill bits 210, 212 and the drill pipes 206, 208 that are to be accommodated in the receptacles 222, 224, 226, 228. Accordingly, the thickness "T" of the configurable sleeve 242 may vary, based on the application requirements.

Figure 5:
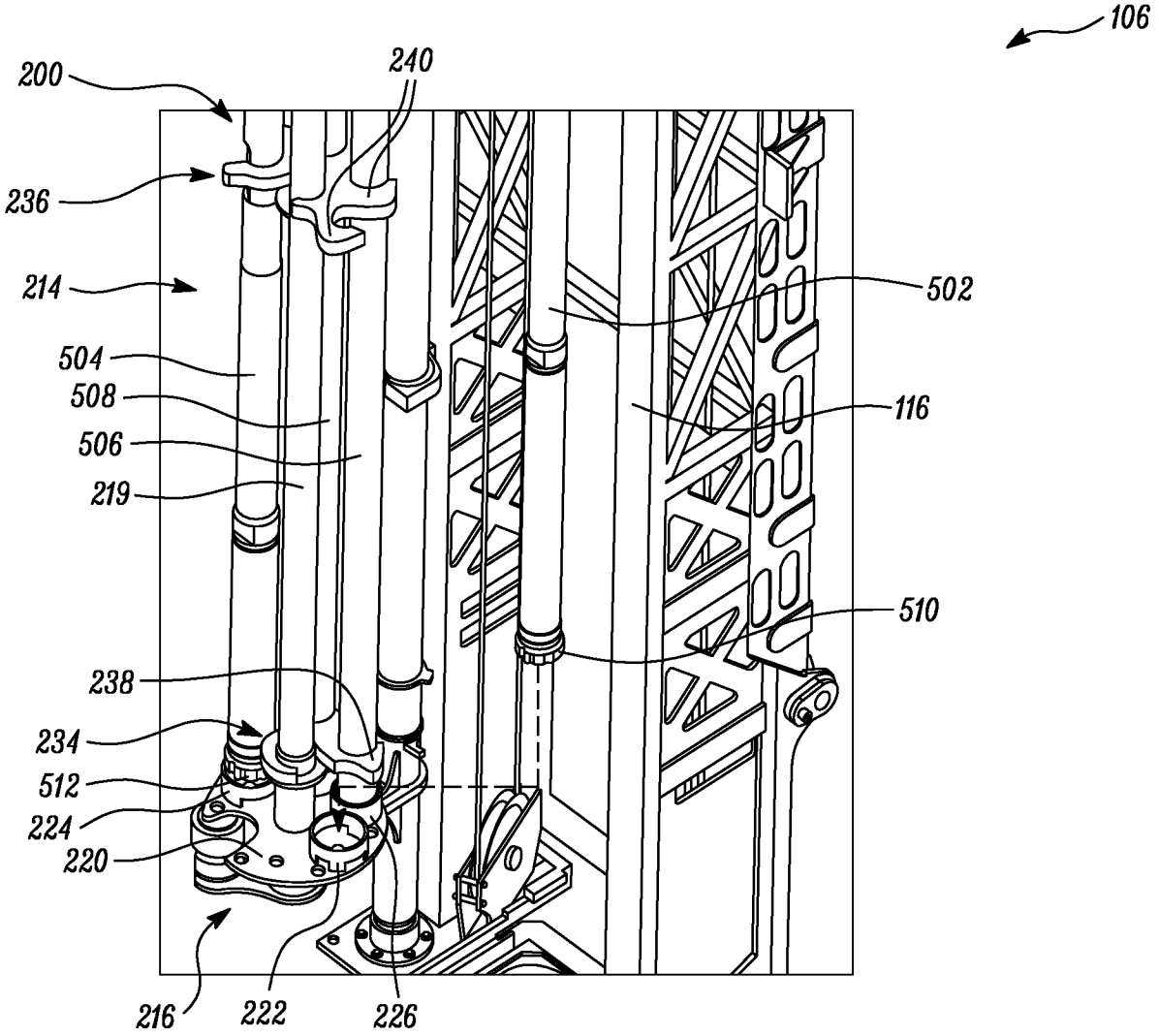
FIG. 5 is a perspective view of a portion of the pipe rack of FIG. 2, according to another embodiment of the present disclosure.

Referring to FIG. 5, a perspective view of a portion of the pipe rack 200 is illustrated, according to another embodiment of the present disclosure. The pipe rack 200 includes two drill strings 502, 504 and two drill pipes 506, 508. In the illustrated embodiment of FIG. 5, the two drill strings 502, 504 of the pipe rack 200 includes a drill bit 510, 512, respectively. Further, the drill bit 510, 512 of the two drill strings 502, 504 are of a same type. In the illustrated embodiment of FIG. 5, each drill bit 510, 512 includes the DTH drill bit. Alternatively, each drill bit 510, 512 may include the rotary drill bit. Further, the drill bit 510, 512 of the two drill strings 502, 504 may be of a same size. Alternatively, the drill bit 510, 512 of the two drill strings 502, 504 may have different sizes.

Figure 6:
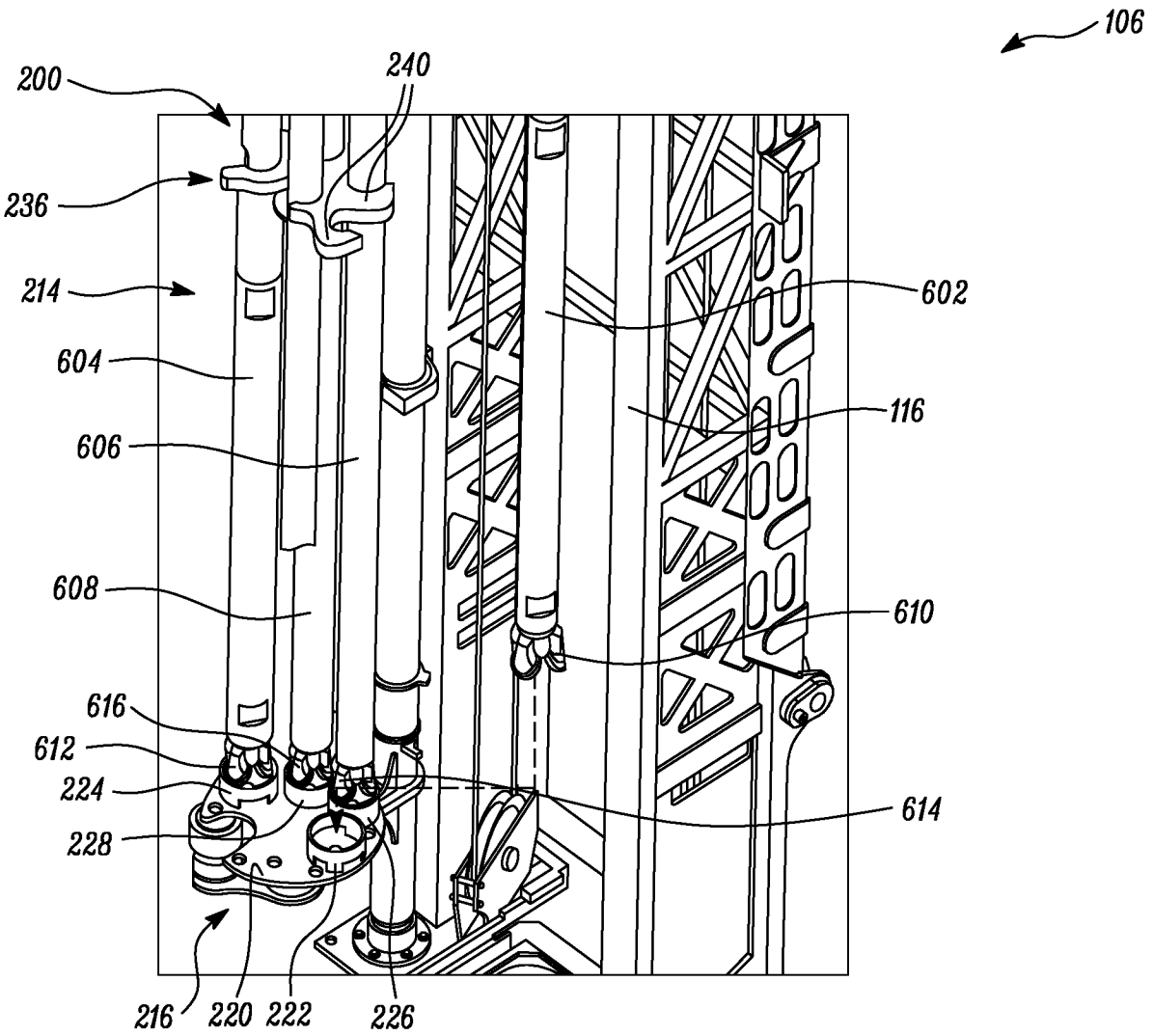
FIG. 6 is a perspective view of a portion of the pipe rack of FIG. 2, according to yet another embodiment of the present disclosure.

Referring to FIG. 6, a perspective view of a portion of the pipe rack 200 is illustrated, according to yet another embodiment of the present disclosure. For the purpose of clarity and explanation, some components of the drill carousel 214, such as the first breaker plate 234, are not illustrated in FIG. 6. In the illustrated embodiment of FIG. 6, the pipe rack 200 includes four drill strings 602, 604, 606, 608. Each of the four drill strings 602, 604, 606, 608 of the pipe rack 200 includes a corresponding drill bit 610, 612, 614, 616. Further, the drill bits 610, 612, 614, 616 are of the same type. In the illustrated embodiment of FIG. 6, each drill bit 610, 612, 614, 616 includes the rotary drill bit. Alternatively, each drill bit 610, 612, 614, 616 may include the DTH drill bit. Furthermore, the drill bits 610, 612, 614, 616 may be of the same size. Alternatively, the drill bits 610, 612, 614, 616 may have different sizes.

Figure 7:
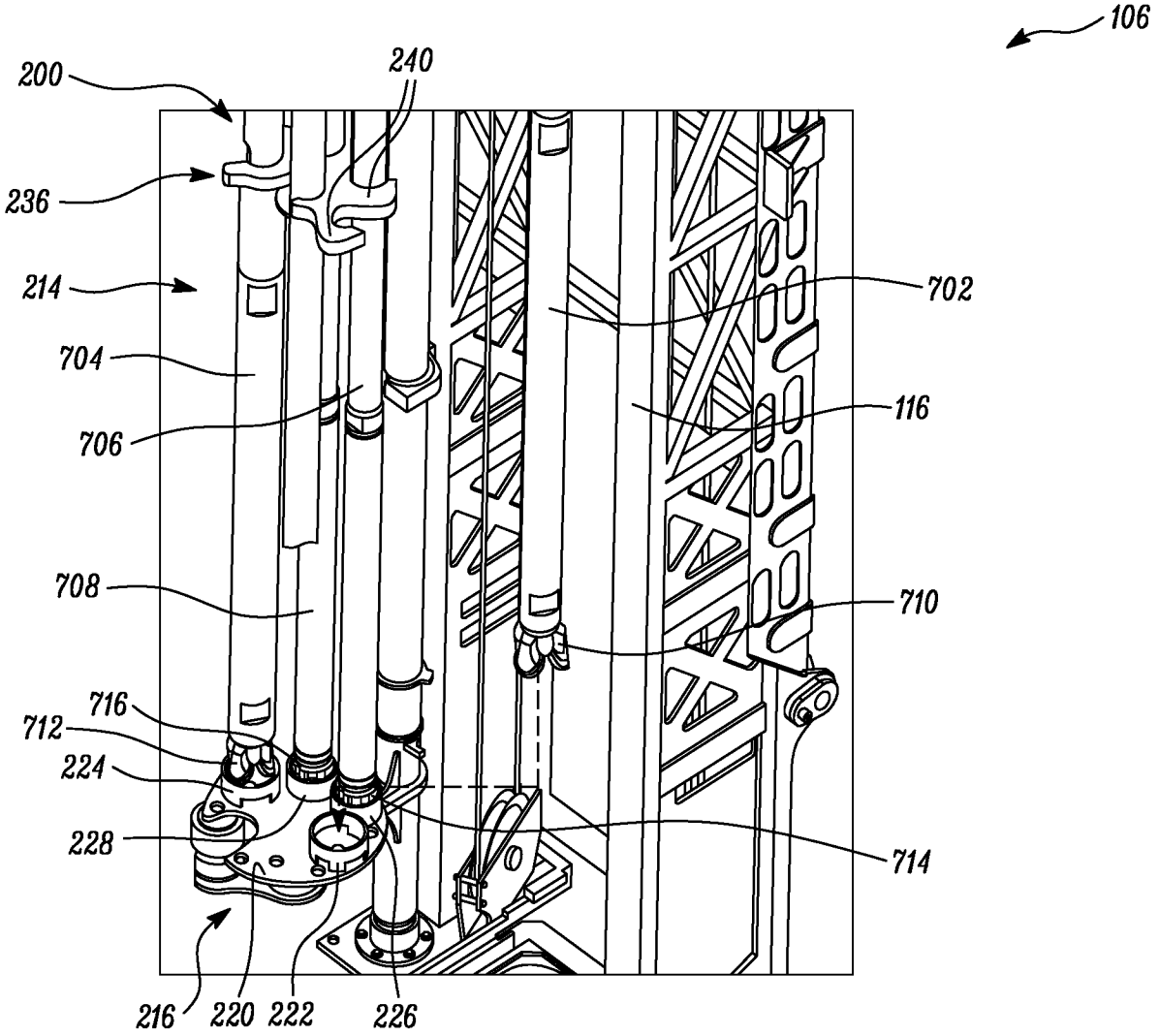
FIG. 7 is a perspective view of a portion of the pipe rack of FIG. 2, according to an embodiment of the present disclosure.

Referring now to FIG. 7, a perspective view of a portion of the pipe rack 200 is illustrated, according to an embodiment of the present disclosure. For the purpose of clarity and explanation, some components of the drill carousel 214, such as the first breaker plate 234, are not illustrated in FIG. 7. In the illustrated embodiment of FIG. 7, the pipe rack 200 includes four drill strings 702, 704, 706, 708. Each of the four drill strings 702, 704, 706, 708 of the pipe rack 200 includes a corresponding drill bit 710, 712, 714, 716. Further, the drill bit 710, 712 of each of the drill strings 702, 704 are of a same type. In the illustrated embodiment of FIG. 7, the drill bits 710, 712 include the rotary drill bit. Furthermore, the drill bit 714, 716 of each of the drill strings 706, 708 are of the same type. In the illustrated embodiment of FIG. 7, the drill bits 714, 716 include the DTH drill bit.

Further, each of the drill bits 710, 712, 714, 716 of the drill strings 702, 704, 706, 708 may be of a same size. In other examples, the sizes of each of the drill bits 710, 712 of the drill strings 702, 704 may be the same, and the sizes of each of the drill bits 714, 716 of the drill strings 706, 708 may be the same. Alternatively, each of the drill bits 710, 712, 714, 716 of the drill strings 702, 704, 706, 708 may have a different size.

It is to be understood that individual features shown or described for one embodiment may be combined with individual features shown or described for another embodiment. The above-described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the pipe rack 200 for the machine 100. The pipe rack 200 includes the drill carousel 214 that may be used for supporting the drill strings 202, 204, 502, 504, 602, 604, 606, 608, 702, 704, 706, 708 of different types and sizes. Further, the pipe rack 200 may also support the drill pipes 206, 208, 506, 508 of different sizes. Based on the drill string 202, 204, 502, 504, 602, 604, 606, 608, 702, 704, 706, 708 being supported by the drill carousel 214, the machine 100 may be used to perform different types of drilling operations on the ground surface without requiring different machines. Such a technique may reduce an operating cost for performing the drilling operations as a single machine may be used to perform different drilling operations. Moreover, the pipe rack 200 described herein may also reduce a time that may be otherwise spent on replacement of different drill strings to perform different drilling operations at a worksite.

As shown in FIGS. 2 and 3, the pipe rack 200 includes the drill strings 202, 204. The drill strings 202, 204 may be of different types and different sizes. Thus, the pipe rack 200 may provide a flexibility to drill holes at the worksite having varying soil conditions. Further, as the sizes of the drill bits 210, 212 may be different from each other, each of the drill bits 210, 212 may be used for drilling different holes having different diameters. In other words, the single pipe rack 200 may be used to drill holes having different diameters. Alternatively, the drill strings 202, 204 may be of the same size.

The pipe rack 200 described herein may also allow mounting of the drill pipes 206, 208 of different sizes. Further, the two drill pipes 206, 208 may extend the lengths of the corresponding drill strings 202, 204, based on a depth of the hole to be drilled. Overall, the embodiment illustrated and explained in reference to FIGS. 2 and 3 may be particularly advantageous in drilling holes that are longer in depth, when holes of different diameters are to be drilled at the same worksite, and/or when the soil conditions require usage of different types of drill bits 210, 212 at the worksite.

In another embodiment as illustrated in FIG. 5, the pipe rack 200 disclosed includes the two drill strings 502, 504 of the same type. In an exemplary case, if the drill string 502 gets damaged or worn-out during operation, the drill string 504 may replace the drill string 502 to continue the drilling operation. Further, the two drill pipes 506, 508 may be coupled to the corresponding drill strings 502, 504, based on a depth of the hole to be drilled. Furthermore, the drill bits 510, 512 may have the same size or the drill bits 510, 512 may have different sizes. Overall, the embodiment illustrated and explained in reference to FIG. 5 may be particularly advantageous in drilling holes that are longer in depth, when the drill strings 502, 504 may be prone to damage, and/or when holes of different diameters are to be drilled at the same worksite.

In yet another embodiment as illustrated in FIG. 6, the pipe rack 200 includes the four drill strings 602, 604, 606, 608 of the same type. In an example, the sizes of each of the drill bits 610, 612, 614, 616 may be different from each other, so that the drill bits 610, 612, 614, 616 may be used for drilling holes of different diameters. In another example, each drill bit 610, 612, 614, 616 may be of the same size, so that if one of the drill strings 602, 604, 606, 608 gets damaged during operation, another drill string 602, 604, 606, 608 may be quickly coupled to the rotary drill head 114, thereby reducing machine downtime. Thus, the embodiment illustrated and explained in reference to FIG. 6 may be particularly advantageous in drilling holes that are shorter in depth, when the drill strings 602, 604, 606, 608 may be prone to damage, and/or when holes of different diameters are to be drilled at the same worksite.

In an embodiment as illustrated in FIG. 7, the pipe rack 200 includes the four drill strings 702, 704, 706, 708 mounted on the drill carousel 214. The drill bits 710, 712 are embodied as rotary drill bits and the drill bits 714, 716 are embodied as DTH drill bits. In an example, each drill bit 710, 712 embodied as the rotary drill bit may be of different sizes, so that holes of different diameters may be drilled at the worksite. In another example, each drill bit 710, 712 embodied as the rotary drill bit may be of the same size, so that if one of the drill strings 702, 704 gets damaged during operation, another drill string 702, 704 may be quickly coupled to the rotary drill head 114, thereby reducing machine downtime.

Further, in an example, each drill bit 714, 716 embodied as the DTH drill bit may be of the different sizes, so that holes of different diameters may be drilled at the worksite. In another example, each drill bit 714, 716 embodied as the DTH drill bit may be of the same size, so that if one of the drill strings 706, 708 gets damaged during operation, another drill string 706, 708 may be quickly coupled to the rotary drill head 114, thereby reducing machine downtime. Thus, the embodiment illustrated and explained in reference to FIG. 7 may be particularly advantageous in drilling holes that are shorter in depth and/or when the drill strings 702, 704, 706, 708 may be prone to wear or damage and/or when operating ground conditions are different, demanding usage of both rotary and DTH drill bits of various sizes.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A pipe rack for a machine, the pipe rack comprising:

a drill carousel adapted to support at least two drill strings, the drill carousel defining a first end and a second end spaced apart from the first end along a first axis of the machine, the drill carousel including:

a base disposed proximate to the first end of the drill carousel; and a plurality of receptacles coupled to and extending from the base, wherein at least two of the plurality of receptacles are adapted to at least partially receive a corresponding drill string from the at least two drill strings, wherein each of the at least two drill strings include a drill bit, wherein each receptacle is adapted to receive a removable sleeve for accommodating different sizes of the drill bit on the corresponding drill string;

a retainer plate coupled to the drill carousel proximate to the second end of the drill carousel, wherein the retainer plate is adapted to couple with the at least two drill strings; and at least one breaker plate disposed between the base and the retainer plate, wherein the at least one breaker plate is spaced apart from the retainer plate along the first axis.

2. The pipe rack of claim 1, wherein the drill bit includes at least one of a rotary drill bit and a down-the-hole drill bit.

3. The pipe rack of claim 2, wherein the drill bit of each of the at least two drill strings are of a same type.

4. The pipe rack of claim 2, wherein the drill bit of each of the at least two drill strings are of different types.

5. The pipe rack of claim 2, wherein the drill bit of each of the at least two drill strings are of a same size.

6. The pipe rack of claim 2, wherein the drill bit of each of the at least two drill strings are of different sizes.

7. The pipe rack of claim 1, wherein each of the plurality of receptacles is adapted to at least partially receive a corresponding drill string.

8. The pipe rack of claim 1, wherein the drill carousel is further adapted to support one or more drill pipes.

9. The pipe rack of claim 8, wherein one or more of the plurality of receptacles is adapted to removably receive the removable sleeve for accommodating at least one of the drill strings and the drill pipes.

10. The pipe rack of claim 8, wherein the at least one breaker plate includes a first breaker plate disposed proximate to the base and a second breaker plate disposed between the first breaker plate and the retainer plate, the first and second breaker plates being adapted to couple with at least one of the drill pipes and the drill strings.

11. A machine comprising:

a frame;

a drilling mast supported by the frame; and a pipe rack mounted on the drilling mast, the pipe rack including:

a drill carousel adapted to support at least two drill strings, the drill carousel defining a first end and a second end spaced apart from the first end along a first axis of the machine, the drill carousel including:

a base disposed proximate to the first end of the drill carousel; and a plurality of receptacles coupled to and extending from the base, wherein at least two of the plurality of receptacles are adapted to at least partially receive a corresponding drill string from the at least two drill strings, wherein each of the at least two drill strings include a drill bit, wherein each receptacle is adapted to receive a removable sleeve for accommodating different sizes of the drill bit on the corresponding drill string;

a retainer plate coupled to the drill carousel proximate to the second end of the drill carousel, wherein the retainer plate is adapted to couple with the at least two drill strings; and at least one breaker plate disposed between the base and the retainer plate, wherein the at least one breaker plate is spaced apart from the retainer plate along the first axis.

12. The machine of claim 11, wherein the drill bit includes at least one of a rotary drill bit and a down-the-hole drill bit.

13. The machine of claim 12, wherein the drill bit of each of the at least two drill strings are of a same type.

14. The machine of claim 12, wherein the drill bit of each of the at least two drill strings are of different types.

15. The machine of claim 12, wherein the drill bit of each of the at least two drill strings are of a same size.

16. The machine of claim 12, wherein the drill bit of each of the at least two drill strings are of different sizes.

17. The machine of claim 11, wherein each of the plurality of receptacles is adapted to at least partially receive a corresponding drill string.

18. The machine of claim 11, wherein the drill carousel is further adapted to support one or more drill pipes.

19. The machine of claim 18, wherein one or more of the plurality of receptacles is adapted to removably receive the removable sleeve for accommodating at least one of the drill strings and the drill pipes.

20. The machine of claim 18, wherein the at least one breaker plate includes a first breaker plate disposed proximate to the base and a second breaker plate disposed between the first breaker plate and the retainer plate, the first and second breaker plates being adapted to couple with at least one of the drill pipes and the drill strings.

* * * * *